US010737454B2

(12) United States Patent
Kohn et al.

(10) Patent No.: US 10,737,454 B2
(45) Date of Patent: Aug. 11, 2020

(54) METHOD AND MACHINE FOR QUALITY CONTROL INSPECTION OF PINCH BOTTOM AND FLAT BOTTOM BAGS

(71) Applicants: Steve Kohn, Short Hills, NJ (US); Luis DeOliveira, Lanoka Harbor, NJ (US); Libanio S. Almeida, Freehold, NJ (US)

(72) Inventors: Steve Kohn, Short Hills, NJ (US); Luis DeOliveira, Lanoka Harbor, NJ (US); Libanio S. Almeida, Freehold, NJ (US)

( * ) Notice: Subject to any disclaimer, the term of this patent is extended or adjusted under 35 U.S.C. 154(b) by 213 days.

(21) Appl. No.: 15/713,675

(22) Filed: Sep. 24, 2017

(65) Prior Publication Data

US 2019/0091958 A1 Mar. 28, 2019

(51) Int. Cl.

*B31B 70/00* (2017.01)
*B31B 70/98* (2017.01)
*B31B 70/96* (2017.01)

(52) U.S. Cl.

CPC ..... *B31B 70/006* (2017.08); *B31B 70/98* (2017.08); *B31B 70/96* (2017.08)

(58) Field of Classification Search

CPC ..... B31B 70/006; B31B 70/98; B31B 70/96
USPC ..... 493/37
See application file for complete search history.

(56) References Cited

U.S. PATENT DOCUMENTS 2,606,483 A * 8/1952 Forbes, Jr. ..... B65G 57/11 414/789.1
3,488,693 A * 1/1970 Brinkmeier ..... B65H 33/16 414/788.3
3,962,845 A * 6/1976 Mojden ..... B65B 5/067 53/500
3,971,189 A * 7/1976 Mojden ..... B65B 43/18 53/505
4,578,052 A * 3/1986 Engel ..... G01B 7/02 493/11
4,720,229 A * 1/1988 Steinhart ..... B65H 31/3018 198/468.11
4,938,657 A * 7/1990 Benson ..... B65G 57/06 271/188
5,346,206 A * 9/1994 Steinhart ..... B65H 29/60 271/305
5,370,382 A * 12/1994 Wetter ..... B65H 31/3018 271/183
10,220,417 B2 * 3/2019 Ritondo ..... B07C 5/02
2011/0224820 A1 * 9/2011 Gammerler ..... B65H 31/3018 700/218
2015/0141228 A1 * 5/2015 Schalck ..... B31B 70/00 493/241

* cited by examiner

*Primary Examiner* — Sameh Tawfik
(74) *Attorney, Agent, or Firm* — Weiss & Weiss Attorneys; Philip Weiss

(57) ABSTRACT

A method and machine for visual inspection of bags for quality control, in particular providing a way to inspect pinch bottom bags and flat bottom bags continuously exiting a production line, without the need to stop or delay the production or movement of the bags.

19 Claims, 10 Drawing Sheets

METHOD AND MACHINE FOR QUALITY CONTROL INSPECTION OF PINCH BOTTOM AND FLAT BOTTOM BAGS

FIELD OF THE INVENTION

The invention relates to a method and machine for visual inspection of bags for quality control, in particular, providing a way to inspect pinch bottom bags and flat bottom bags continuously exiting a production line, without the need to stop or delay the production or movement of the bags.

BACKGROUND OF THE INVENTION

The prior art teaches various methods and machines for forming pinch bottom and flat bottom bags and for forming bundles of the bags.

U.S. Pat. No. 9,663,320 relates to a method for forming packs of flat bags, a continuous line of bags moving in an oriented direction of advance. The bags are moved onto a receiving table on which the bags are stacked while being stopped from moving in the oriented direction of advance by an abutment. The continuous line of bags is converted into a line of overlapped bags before stacking the latter, and the bags are separated on the receiving table by a separating means comprising a separating device. During this operation, a separating device is inserted by a movement in the separating direction perpendicular to the plane of the bags between a preceding bag and a following bag in the overlapped line in such a way that, when the following bag stops against the abutment, it is supported at least partially by the separating means.

US patent publication 20150141228 relates to a machine for manufacturing flat bottom bags. The machine includes a drum for carrying at least one blank having a flattened tubular shape in an advancing direction, a scoring apparatus upstream of the drum for marking on the blank a folding line which is transverse with respect to the advancing direction, a front gripper on the drum that grips a front edge of the blank on the drum and carries the blank, and a first lateral gripping means on the drum that grips the lateral edges of the blank in the region of the first folding line.

US patent publication 20090110534 relates to a bag supply apparatus for supplying bags onto a conveyor for transporting a bag bundle. The bag bundle is stacked such that an upper level bag is shifted forward. The apparatus includes a bag lifting device, which is provided with a pair of bag support members disposed facing one another on the left and right sides near the rear edge of a belt conveyor. The apparatus further includes a rotation mechanism, which imparts translational motion of rotation in symmetric in a vertical plane with respect to the conveyance direction of the belt conveyor. The bag supporting portions of the bag support members contact the bag bundle from below to lift up the rear edge portion of the bag bundle and then separate from the bag bundle outwardly. While the bag supporting portions lift the bag bundle, a new bag is fed into the space between the conveyance surface of the belt conveyor and the bag bundle.

SUMMARY OF THE INVENTION

The present invention relates to a machine and method of offline, quality control inspection of a single stack or multiple stacks of bags from a bag production line, followed by a machine and method of returning the single stack or multiple stacks of bags to the production line. It is an object of the present invention for the visual inspection to occur without interrupting or having to stop the handling or packing of the bags.

A pinch bottom bag is made of a flexible material such as paper, polyethylene film or a combination of the two. A pinch bottom bag comprises a tubular envelope closed at one end by a glued flap. A flat bottom bag is made of flexible material such as paper, polyethylene film or a combination of the two. A flat bottom bag comprises a tubular envelope closed at one end by a flat bottom. Plastic bag manufacturing starts with a blown bubble which is then flattened into a sheet for forming bags. Paper bag manufacturing starts with a paper roll unwinding into a flat sheet. These bags are produced on a bag machine wherein the flexible material forms a rolled sheet, then forms a bead which is flattened, cut and closed at one end. The bag machine then forms either a single or multiple stacks of the bags. The stack or stacks of bags leave the bag machine on a conveyor belt and are driven to an adjoining platform (receiving table) on which the stack or stacks of bags are placed in parallel in either horizontal or vertical alignment. It is an object of the present invention that from this receiving table, a mechanical device picks up and moves each stack of bags to a separate machine where several stacks of bags are wrapped together to form packs or bundles. It is an object of the present invention for the device to comprise a robotic arm.

To ensure that the bags meet quality control standards, a sample quantity of bags is removed from the bag machine's receiving table and visually inspected. If found to not meet quality standards, the bags are removed from the sample and scrapped. Disposal of inspected bags that meet quality requirements can be costly. Therefore, bags that have passed quality control inspection are returned for inclusion in the packing or bundling operation.

It is an object of the present invention to provide a method to remove a single stack or multiple stacks of bags from the receiving table for inspection and return the stack or stacks of bags into the bag packing or bundling line without interrupting the arrival of subsequent stacks of bags on the receiving table The present invention relates to a method to remove a single stack or multiple stacks of bags for inspection where the stack or stacks of bags is diverted from the receiving table on which the stack or stacks of bags is received from a bag machine and the stack or stacks of bags is returned to a staging area so that the bags are subsequently moved to a packing or bundling machine. It is an object of the present invention for the method to comprise receiving a stack or multiple stacks of bags from the bag machine with the bags in the stack in a horizontal orientation (laying on broad side). It is an object of the present invention for the method to comprise receiving a stack or multiple stacks of bags from the bag machine with the bags in the stack in a vertical orientation (laying on edge).

It is an object of the present invention for the method to comprise a bag machine diverting a single stack or multiple stacks of bags from a receiving table onto an adjacent space, thereby allowing for additional stacks of bags to be received in the resulting vacancy on the receiving table. It is an object of the present invention for the method to comprise a separating means for diverting the single stack or multiple stacks of bags from the receiving table onto an adjacent space. It is an object of the present invention for the method to comprise a separating device moving in a horizontal or vertical orientation. It is an object of the present invention for the method to comprise the separating device moving from the far side of the receiving table and pushing a single stack or multiple stacks of bags horizontally from the receiving table onto an adjacent space on the receiving table. It is an object of the present invention for the separating device to comprise one or more protrusions.

It is an object of the present invention for the method to comprise creating a vacancy on the receiving table when the separating device moves the single stack or multiple stacks of bags onto the adjacent space, thereby eliminating the need to slow down or temporarily stop the bag production process or the receipt of subsequent stacks of bags on the receiving table.

It is an object of the present invention for the method to comprise removing a single stack or multiple stacks by a machine operator. It is an object of the present invention for the method to comprise a machine operator visually inspecting each bag for defects. It is an object of the present invention for the method to comprise the machine operator removing any defective bags. It is an object of the present invention for the method to comprise the separating device returning to its starting position once the single stack or multiple stacks of bags have been moved to the adjacent space.

It is an object of the present invention for the method to comprise removing a single stack or multiple stacks by a mechanical device. It is an object of the present invention for the method to comprise a device having a sensor that inspects each bag in the stack for defects. A defect can be a rip, smudge or any other feature that makes it different from the other stacks of bags. A defect can also be a bag with inadequate glue or paste, or a bag that has an irregular shape. It is an object of the present invention for the method to comprise a device for removing any defective bags.

It is an object of the present invention for the method to comprise the returning of inspected bags to an area above, adjacent or below the receiving table (staging area). It is an object of the present invention for the staging area to comprise a drawer that opens and closes. It is an object of the present invention for the method to comprise an operator or device that opens the drawer and places bags within the drawer. It is an object of the present invention for the method to comprise the operator or a device that closes the drawer thereby returning the drawer to its initial position in the staging area above, adjacent or below the receiving table. It is an object of the present invention for the holding areas in the drawers to be adjustable to hold different size bags.

It is an object of the present invention for the method to comprise using a mechanical device to pick up bags from the drawer and move the bags into the holding area to the packing or bundling machine. It is an object of the present invention for the device to be a robotic arm. It is an object of the present invention for the method to comprise using a robotic arm for the movement of bags from the drawer to the holding area so as to not interrupt the regular movement of bags onto and from the receiving table. It is an object of the present invention to advance a predetermined number of bags from the holding area to the bundler. It is an object of the present invention to advance via a robotic arm a predetermined number of bags from the holding area to the bundler. It is an object of the present invention for the bundler to wrap the predetermined number of bags in a wrapping material such as polyethylene or paper. It is an object of the present invention to advance the wrapped bundle of bags by a conveyor belt to an area for final packaging.

It is an object of the present invention for the method and machinery to also be used on other stacked items such as a stack of paper.

DETAILED DESCRIPTION OF THE DRAWINGS

Figure 1:
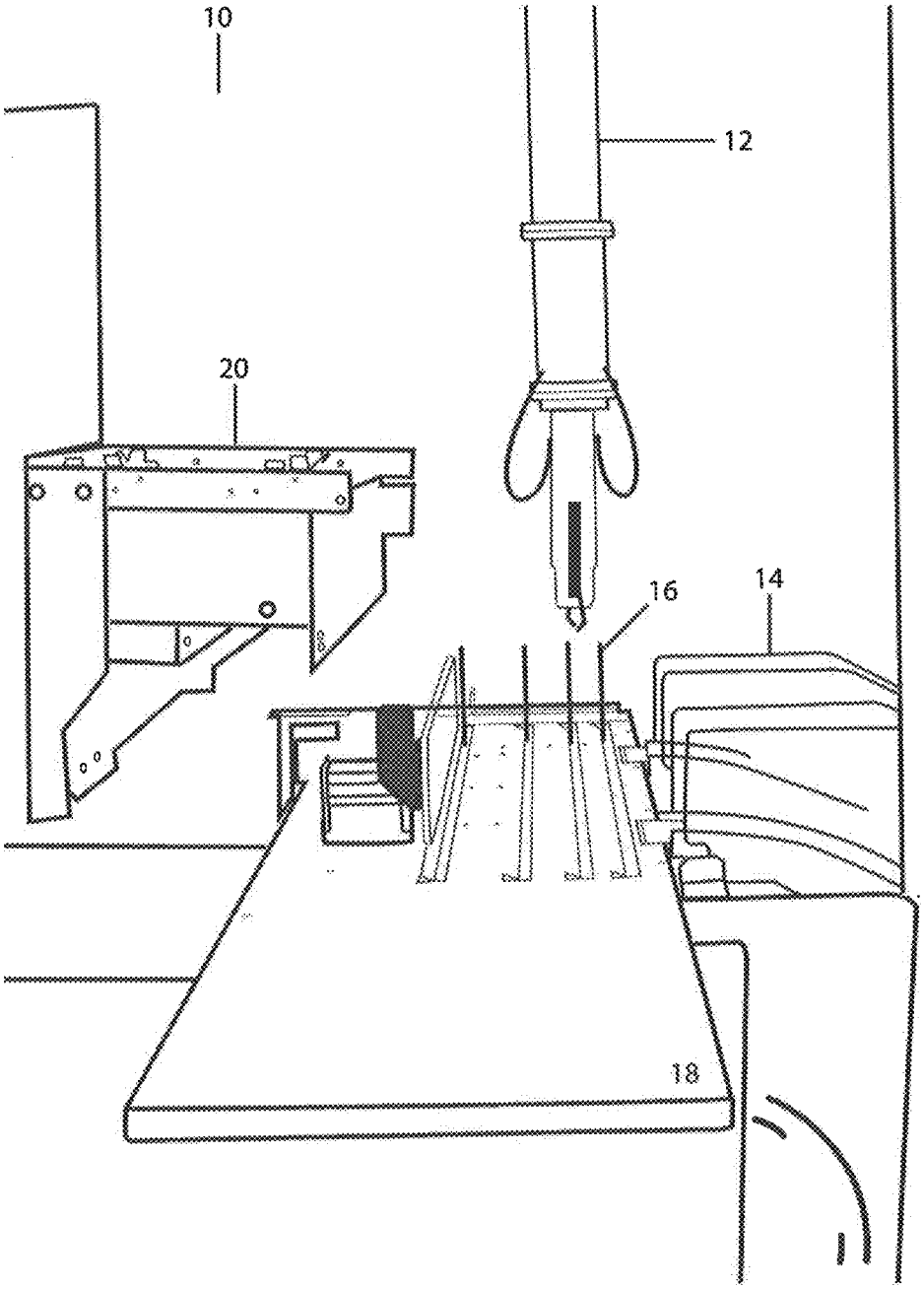
FIG. 1 is a side view of the area and machinery in a standby state for inspection of bags.

FIG. 1 shows quality control inspection area 10 with stacks of bags 30 (not shown) in vertical orientation received from conveyor 14 of a bag machine; separating device 16 in its starting position; robotic arm 12 for moving stacks of bags 30; receiving table 18; and drawer 20 for holding stacks of bags 30 to be moved to bundler (not shown).

Figure 2:
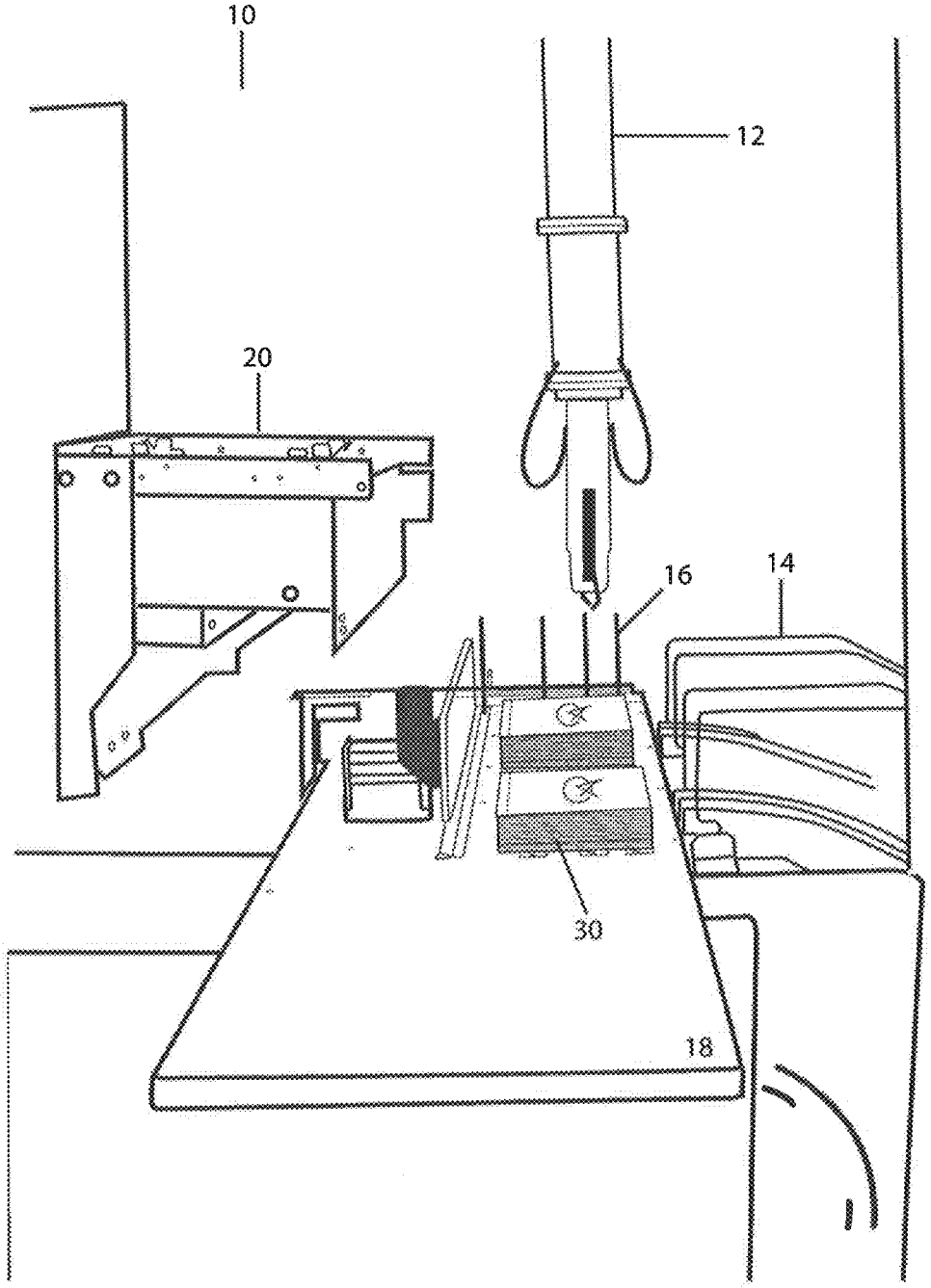
FIG. 2 is a side view of the area and machinery for inspection of bags with stacks of bags received from the bag machine conveyor.

FIG. 2 shows quality control inspection area 10 with stacks of bags 30 in horizontal orientation received from the conveyor 14 of the bag machine; separating device 16 in its starting position; robotic arm 12 for moving stacks of bags 30; receiving table 18; and drawer 20 for holding stacks of bags 30 to be moved to bundler (not shown).

Figure 3:
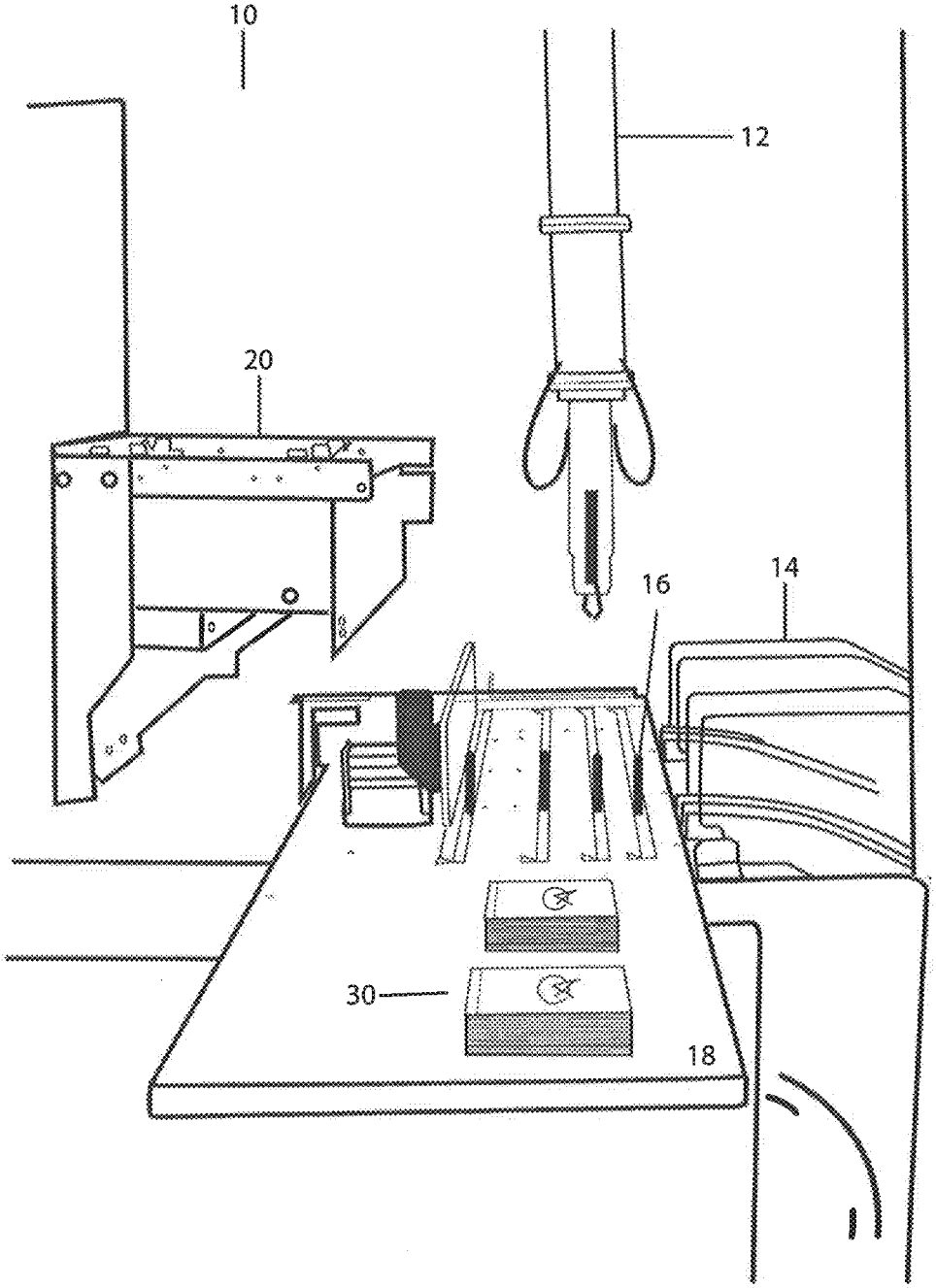
FIG. 3 is a side view of the area and machinery for inspection of bags with stacks of bags moved to receiving table by a representative set of protrusions in the receiving table for moving bags in a horizontal manner (separating device)

FIG. 3 shows quality control inspection area 10 with stacks of bags 30 in horizontal orientation on receiving table 18; separating device 16 on its way back to its starting position after being advanced to push stacks of bags 30 onto receiving table 18; robotic arm 12 for moving stacks of bags 30, receiving table 18; and drawer 20 for holding stacks of bags 30 to be moved to bundler (not pictured).

Figure 4:
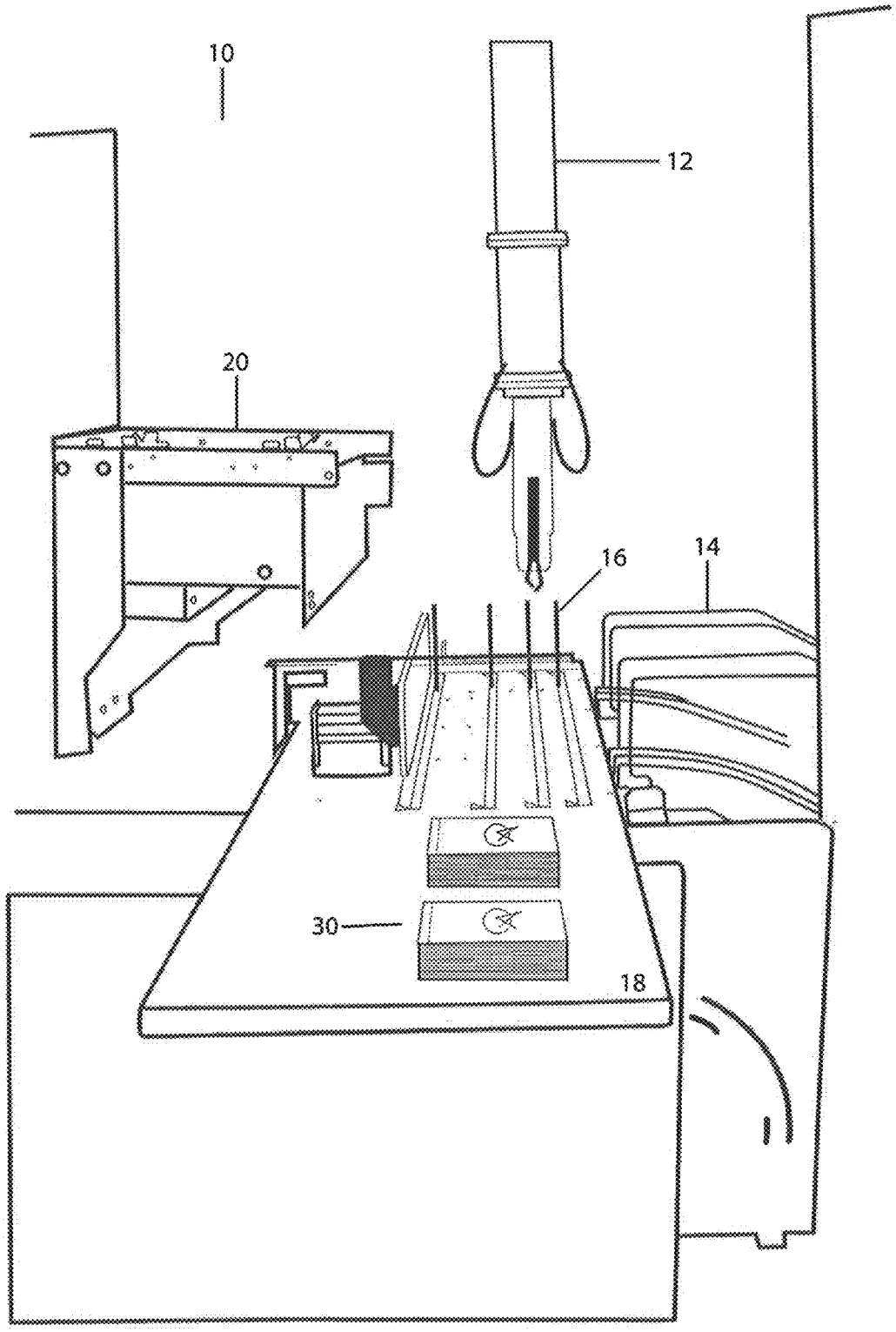
FIG. 4 is a side view of the area and machinery for inspection of bags with stacks of bags moved to receiving table with the separating device returned to the standby location.

FIG. 4 shows quality control inspection area 10 with stacks of bags 30 in horizontal orientation on receiving table 18; separating device 16 in starting position after being advanced to push stacks of bags 30 onto receiving table 18; robotic arm 12 for moving stacks of bags 30, receiving table 18; and drawer 20 for holding stacks of bags 30 to be moved to bundler (not pictured).

Figure 5:
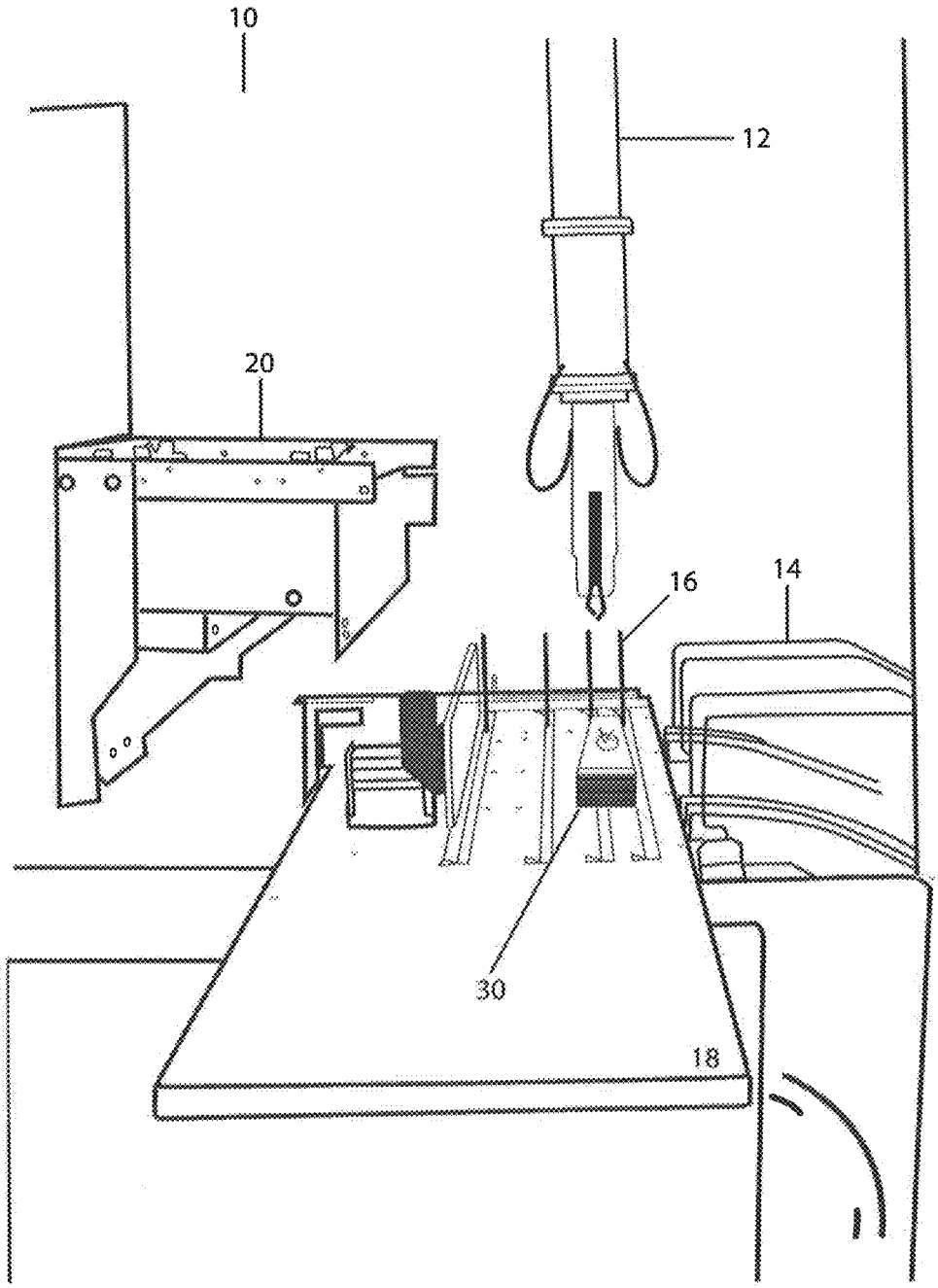
FIG. 5 is a side view of the area and machinery for inspection of bags with stacks of bags received from the bag machine conveyor.

FIG. 5 shows quality control inspection area 10 with stacks of bags 30 in vertical orientation on receiving table 18; separating device 16 on its way back to its starting position after being advanced to push stacks of bags 30 onto receiving table 18; robotic arm 12 for moving stacks of bags 30, receiving table 18; and drawer 20 for holding stacks of bags 30 to be moved to bundler (not pictured).

Figure 6:
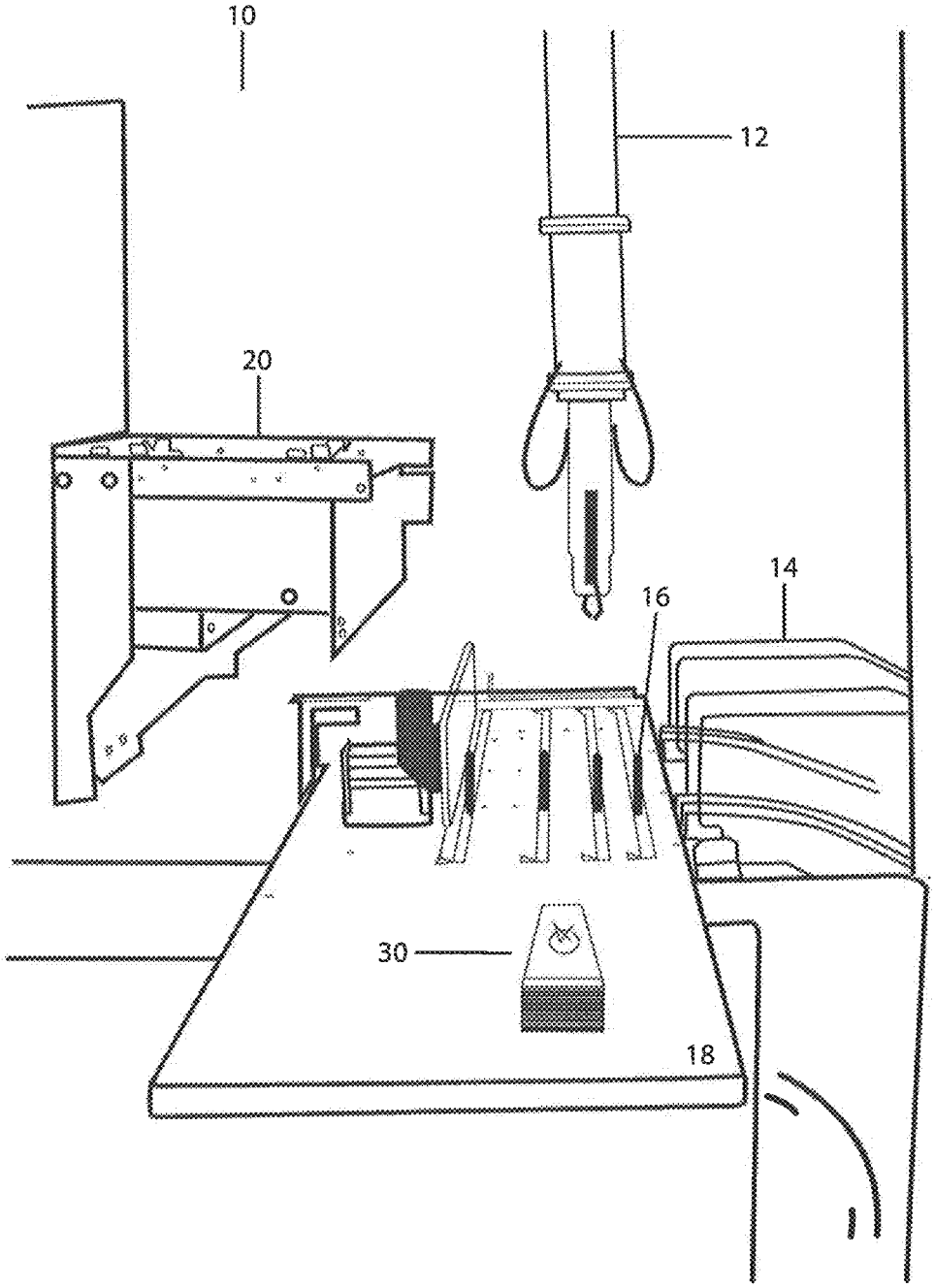
FIG. 6 is a side view of the area and machinery for inspection of bags with stacks of bags moved to receiving table by a representative set of protrusions in the receiving table for moving bags in a horizontal manner (separating device)

FIG. 6 shows quality control inspection area 10 with stacks of bags 30 in vertical orientation on receiving table 18; separating device 16 in starting position after being advanced to push stacks of bags 30 onto receiving table 18; robotic arm 12 for moving stacks of bags 30, receiving table 18; and drawer 20 for holding stacks of bags 30 to be moved to bundler (not pictured).

Figure 7:
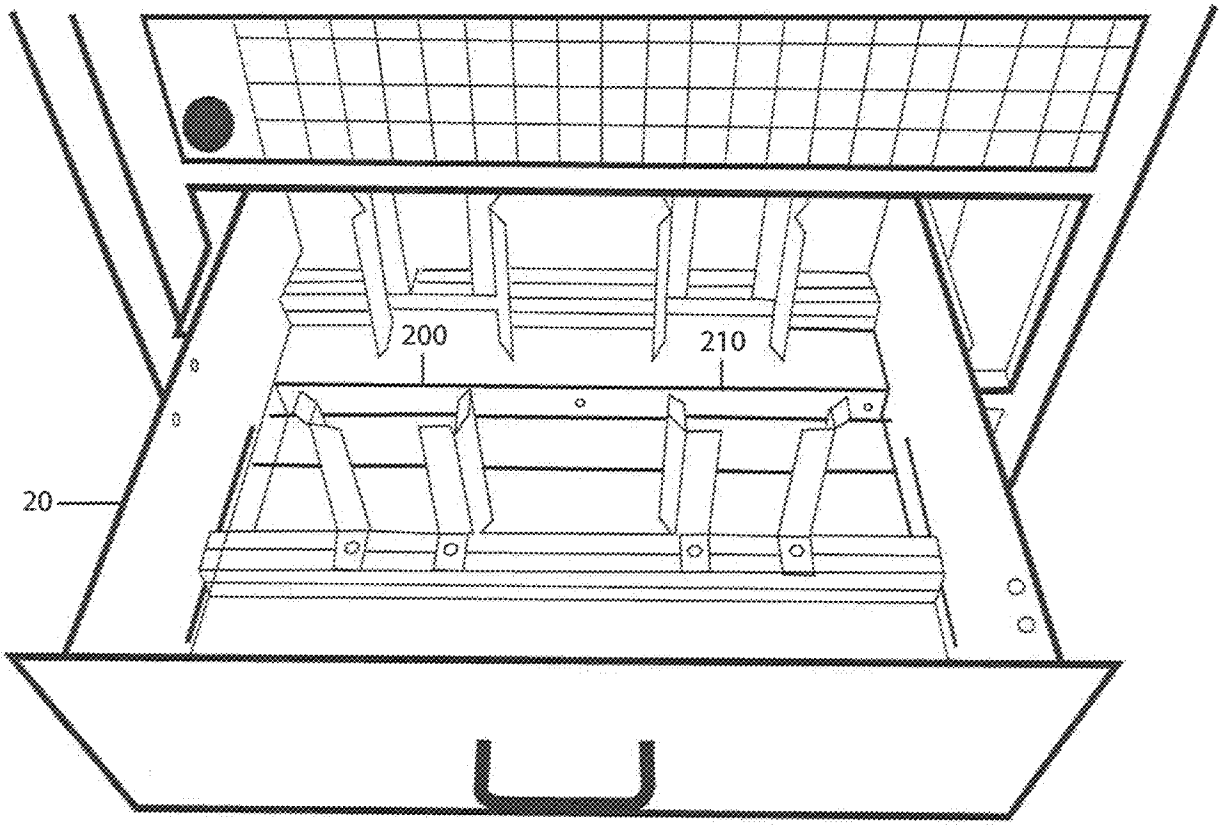
FIG. 7 is a top view of the open drawer in a horizontal position without bags in the staging located above the receiving area.

FIG. 7 shows drawer 20 for holding bags to be moved to the bundler in the open position. Stacks of bags are placed in one or both of the holding areas 200 and 210 within the drawer. Holding areas 200 and 210 can be adjusted for length and width to accommodate different size bags (not shown).

Figure 8:
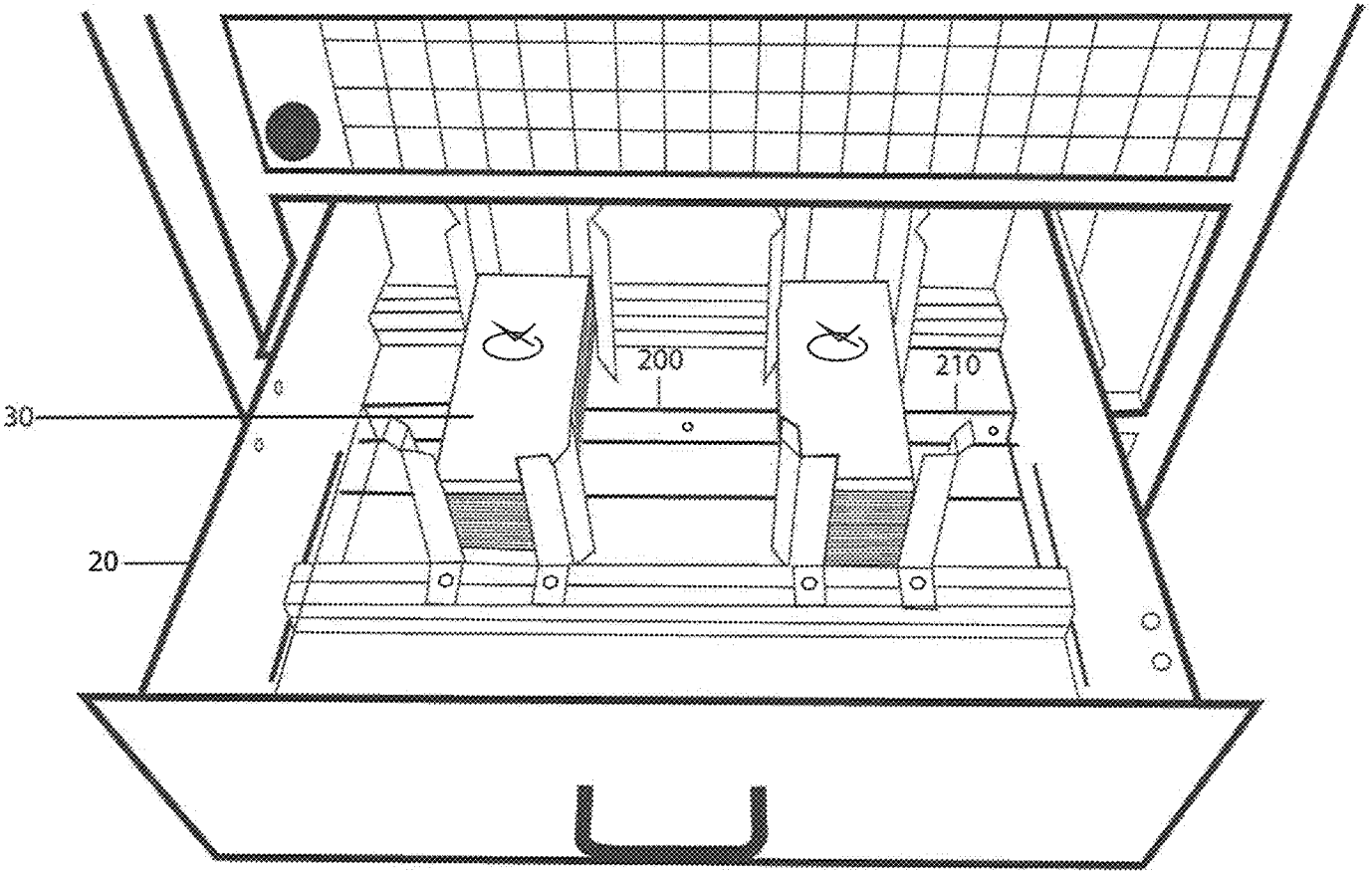
FIG. 8 is a top view of the open drawer in a horizontal position with inspected bags in the staging area located above the receiving table.

FIG. 8 shows drawer 20 for holding bags 30 to be moved to the bundler in the open position. Stacks of bags 30 are placed in one or both of the holding areas 200 and 210 within the drawer. Once holding area is full, drawer 20 is closed and robotic arm 12 (not pictured) picks up stacks of bags 30 from each holding area 200 and 210 and moves bags 30 to bundler (not shown). Holding areas 200 and 210 can be adjusted for length and width to accommodate different size bags (not shown).

Figure 9:
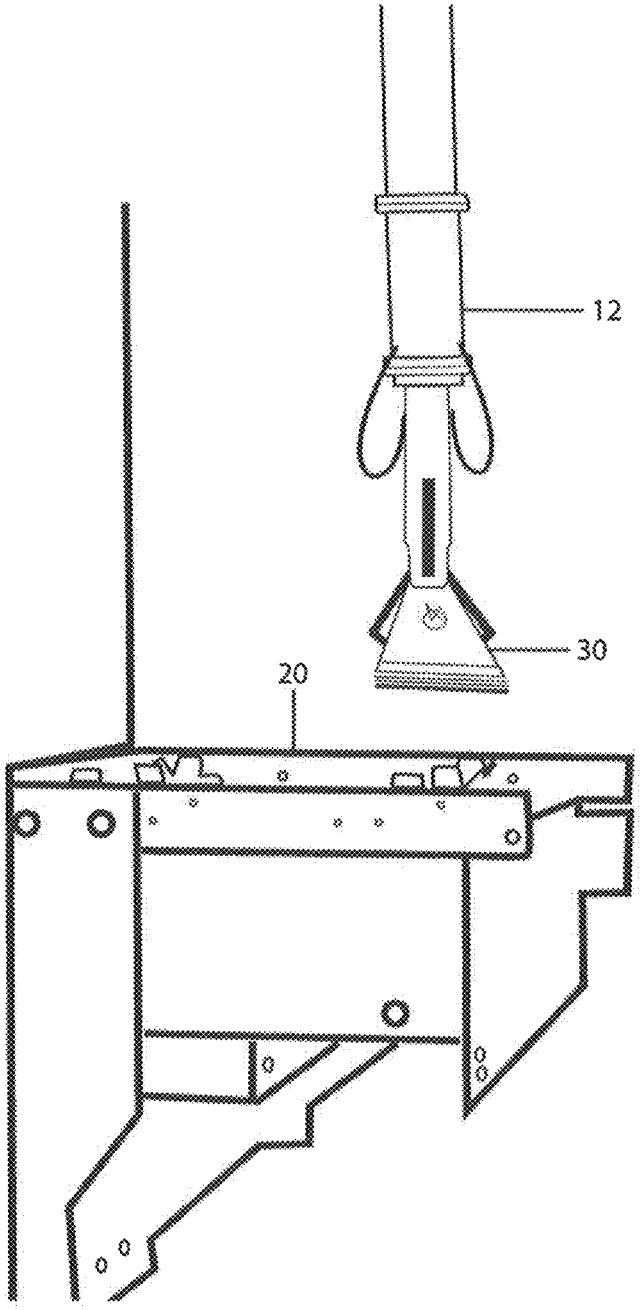
FIG. 9 is side view of robotic arm with stacks of bags coming from a drawer.

FIG. 9 shows a detailed view of robotic arm 12 used for moving stacks of bags 30 from drawer 20.

Figure 10:
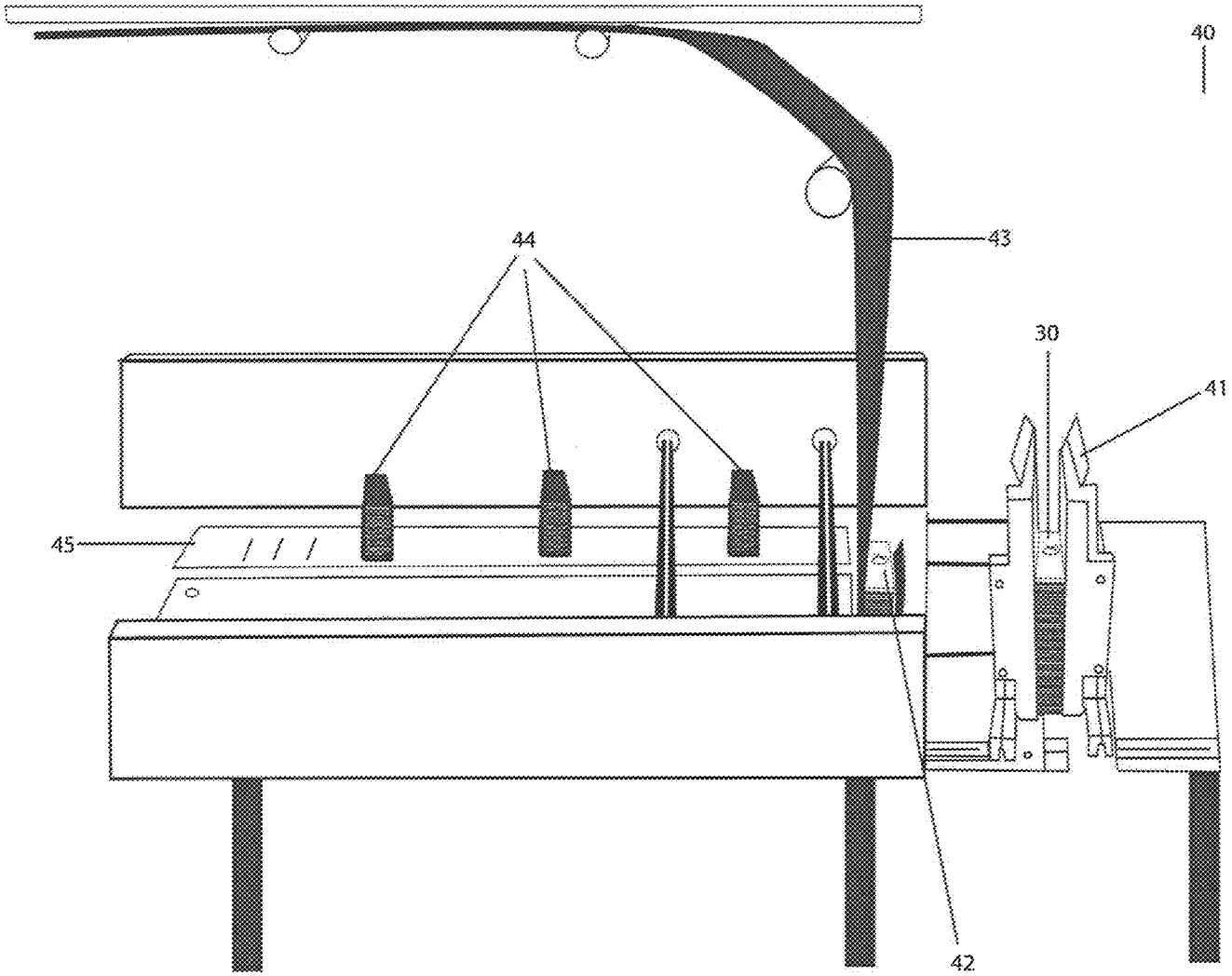
FIG. 10 is a side view of the of the area and machinery for bundling/packing bags.

FIG. 10 shows packing/bundling area 40 with stacks of bags 30 received from the robotic arm (not pictured) in a holding area 41. A stack of bags 42 is comprised of a predetermined number of bags 30 that is advanced from the holding area 41 wherein it is wrapped by a material 43, such as paper or polyethylene to form bundles of bags 44. Bundles of bags 44 are advanced by a conveyor belt 45 to be packaged.

The invention claimed is:

1. A method for visually inspecting individual pinch bottom and flat bottom bags wherein a stack or multiple stacks of bags is received from a bag machine, comprising:

receiving a stack or multiple stacks of bags from a bag machine;

moving said stack or multiple stacks of a predetermined number of said bags on to a receiving table;

moving said stack or multiple stacks of said bags to a separate machine for forming packs or bundles of said bags;

moving a sample of said stack or multiple stacks of said bags in a horizontal and perpendicular direction from direction of advance onto an adjacent platform to said receiving table;

visually inspecting said sample of a stack or multiple stacks of bags;

returning inspected bags that pass quality requirements to a staging area; wherein said bags are moved to said machine for forming packs or bundles of bags.

2. The method of claim 1 wherein said bags are oriented horizontally in said stack.

3. The method of claim 1 wherein said bags are oriented vertically in said stack.

4. The method of claim 1 wherein said stack or multiple stacks of bags is moved from said receiving table to a machine for forming packs or bundles of bags through the use of a robotic arm.

5. The method of claim 1 wherein said sample of said stack or stacks of bags is moved onto an adjacent platform for inspection by a separating device which moves a dual stack of bags.

6. The method of claim 5 wherein said separating device comprises one or more protrusions.

7. The method of claim 5 wherein said separating device does not interfere with receipt of additional stack or multiple stacks of bags moving in horizontal oriented direction of advance by being retractable.

8. The method of claim 5 wherein said movement of said stack or multiple stacks of bags to said adjacent table does not hinder or delay said advancement of subsequent stacks of bags.

9. The method of claim 1 where said stack or multiple stacks of bags on said adjacent platform to said receiving table are removed for visual inspection.

10. The method of claim 9 where inspected bags are placed in a drawer in a plane perpendicular to oriented direction of advance of said stack or stack of bags onto said receiving table from said bag machine.

11. The method of claim 10 wherein said drawer comprises multiple holding areas.

12. The method of claim 11 wherein said holding areas are adjustable to hold different size bags.

13. The method of claim 10 where movement of said stack or multiple stacks of bags from said drawer is through use of a robotic arm.

14. The method of claim 1 where visually inspected bags are moved to a machine for forming packs or bundles of bags without interfering with horizontal oriented direction of advance of another stack or stack of bags.

15. The method of claim 1 wherein said visual inspection is done manually by a machine operator.

16. The method of claim 1 further comprising wrapping together said stack of bags to form packs or bundles.

17. The method of claim 1 further comprising removing said sample of said stack or multiple stacks of said bags if said bags are defective.

18. The method of claim 1 wherein said stack of bags is inspected by a device such as a sensor.

19. The method of claim 1 wherein said method is used with other stacked items such as paper.

* * * * *